US005977007A

United States Patent [19]

Lassow et al.

[11] Patent Number: 5,977,007

[45] Date of Patent: Nov. 2, 1999

[54] ERBIA-BEARING CORE

[75] Inventors: Eliot S. Lassow, N. Muskegon, Mich.; David L. Squier, New Canaan, Conn.; Julie A. Faison, Whitehall, Mich.

[73] Assignee: Howmet Research Corporation, Whitehall, Mich.

[21] Appl. No.: 08/960,996

[22] Filed: Oct. 30, 1997

[51] Int. Cl.[6] ..... B22C 1/02; B22C 9/10

[52] U.S. Cl. ..... 501/152; 501/153; 501/154; 501/133; 501/127; 501/103; 106/38.27; 106/38.2; 106/38.25; 106/38.9; 164/4.1; 164/464; 164/520; 164/529

[58] Field of Search ..... 106/38.27, 38.2, 106/38.25, 38.9; 501/152, 153, 154, 103, 102, 127, 133; 164/4.1, 520, 529, 464

[56] References Cited

U.S. PATENT DOCUMENTS

| | | | |
|---|---|---|---|
| 3,537,949 | 11/1970 | Brown et al. | 161/252 |
| 3,994,346 | 11/1976 | Brown | 164/361 |
| 4,040,845 | 8/1977 | Richerson et al. | 106/38.9 |
| 4,065,544 | 12/1977 | Hamling et al. | 423/252 |
| 4,171,562 | 10/1979 | Freeman et al. | 29/530 |
| 4,703,806 | 11/1987 | Lassow et al. | 164/518 |
| 4,837,187 | 6/1989 | Frank et al. | 501/127 |
| 4,874,725 | 10/1989 | Furukawa et al. | 501/152 |
| 4,947,927 | 8/1990 | Horton | 164/517 |
| 4,966,225 | 10/1990 | Johnson et al. | 164/519 |
| 5,145,833 | 9/1992 | Prunier, Jr. et al. | 501/1 |
| 5,183,801 | 2/1993 | Virkar et al. | 501/152 |
| 5,221,336 | 6/1993 | Horton | 106/38.2 |
| 5,242,007 | 9/1993 | Remmers et al. | 164/4.1 |
| 5,384,293 | 1/1995 | Omori et al. | 501/152 |
| 5,407,001 | 4/1995 | Yasrebi et al. | 164/519 |
| 5,535,811 | 7/1996 | Feagin | 164/139 |

FOREIGN PATENT DOCUMENTS 0 722 919 A1 1/1996 European Pat. Off. .

OTHER PUBLICATIONS

Formation and Thermal Stability of an Oxide Dispersion in a Rapidly Solidified Ti–Er Alloy; Scripta Metallurgica, #7 vol. 17 pp. 963–966, 1983, Kohitzer et al.

The Interaction of Titanium with Refractory Oxides; Titanium Science and Technology, Plenum Press, 1973, pp. 271–284, Lyon et al.

On the Evaluation of Stability of Rare Earth Oxides as Face Coats for Investment Casting of Titanium; Metallurgical Transactions B, vol. 21B, Jun. 1990, pp. 559–566, Saha et al.

*Primary Examiner*—C. Melissa Koslow
*Attorney, Agent, or Firm*—Edward J. Timmer

[57] ABSTRACT

A ceramic core that includes, prior to core sintering, erbia filler material alone or admixed with a second ceramic filler material, such as alumina, and a binder to provide a core that is relatively non-reactive with superalloys used in the manufacture of turbine blades, dimensionally stable during directional solidification (DS) for extended times, removable by chemcial leaching techniques, and having enhanced X-ray detectable during post-cast inspection operations. After core sintering, the ceramic core has a microstructure comprising an erbia-alumina garnet phase and an unreacted ceramic filler phase (e.g. alumina).

17 Claims, 2 Drawing Sheets

0.070" / 0.035"
Alloy Sandwich 0.070"
Alloy 0.140"
Alloy

ERBIA-BEARING CORE

FIELD OF THE INVENTION

The present invention relates to ceramic cores for use in investment casting of metal and alloy components having internal passageways and, in particular, erbia-bearing cores especially useful for investment casting of components with internal cooling passageways.

BACKGROUND OF THE INVENTION

In casting single crystal and columnar grain turbine blades using directional solidification techniques, ceramic cores are positioned in an investment shell mold to form internal cooling passageways in the cast turbine blade. During service in the gas turbine engine, cooling air is directed through the passageways to maintain blade temperature within an acceptable range.

As described by Frank et al. in U.S. Pat. No. 4,837,187 (Howmet Corporation), ceramic cores heretofore used in the casting of nickel and cobalt base superalloy turbine blades have comprised silica, zirconia, alumina, and yttria selected to be relatively non-reactive with the superalloy being cast so as not to react with reactive alloying components thereof, dimensionally stable during directional solidification (DS) when the superalloy melt is cast at high temperatures into a preheated shell mold and solidified about the core for extended times required for DS of single crystal or columnar grained microstructures, and also to be removable within reasonable times from the cast turbine blade by chemical leaching techniques.

In recent turbine blade designs, the cooling passageways are provided with complex serpentine configurations that in turn require a complex core shape. After the cast component is solidified, the mold and core are removed from the component. Typically, the ceramic core is chemically leached out of the cast component using a hot aqueous caustic solution so as to leave cooling passageways in the component.

After the mold and core are removed from the cast component, the component typically is subjected to a post-cast inspection procedure to determine if any residual ceramic core material remains in the cooling passageways after the core leaching operation. The inspection procedure may include neutron radiographic and/or x-ray radiographic techniques. In the neutron radiographic technique, the component is bathed in a Gd-containing solution to tag any residual ceramic core material that may reside in the cooling passageways. Since Gd is a strong neutron absorber, it will indicate the presence of any residual ceramic core material in the passageways during neutron radiography. If residual ceramic core material is detected, then the component is subjected to additional chemical leaching to remove the material.

An x-ray inspection procedure also can be used following removal of the mold and core as described in U.S. Pat. No. 5,242,007 wherein the ceramic core is either doped or tagged with an x-ray detectable agent and subjected to x-ray radiography to detect any residual ceramic core material in the passageways.

An object of the present invention is to provide a ceramic core that exhibits the aforementioned relative non-reactivity with the melt being cast, dimensional stability during solidification, chemical leachablity from the cast component, and enhanced x-ray detectability during post-cast inspection operations.

SUMMARY OF THE INVENTION

The present invention provides in one embodiment a ceramic core that includes, prior to sintering, erbia ($Er_2O_3$) filler material alone or with a second ceramic filler material, and a binder to provide a core that is relatively non-reactive with superalloys used in the manufacture of turbine blades, dimensionally stable during directional solidification (DS) for extended times, removable by chemcial leaching techniques, and exhibits enhanced x-ray detectability during post-cast inspection operations.

In one embodiment of the present invention, the ceramic core consists essentially of, prior to sintering, about 20 to about 35 weight % erbia filler material, about 60 to about 80 weight % second ceramic filler material such as, for example only, alumina, up to about 10 weight % fugitive filler material, and about 10 to about 20 weight % binder.

The erbia filler component of the core preferably comprises calcined or fused erbia powder. The second ceramic filler material can be selected from alumina, silica, yttria, zirconia and other suitable ceramic powders or mixtures thereof. The fugitive filler material can comprise graphite powder. The binder can comprise a thermoplastic wax-based binder.

In accordance with another embodiment of the present invention, a sintered ceramic core has a microstructure comprising an erbia-alumina garnet phase and an unreacted ceramic filler phase, such as alumina. For example, the sintered core can have a microstructure comprising erbia-alumina garnet phase components and unreacted alumina phase components when alumina is the ceramic filler. Some free, unreacted erbia may be present in the sintered microstructure.

The present invention is advantageous in that superalloy turbine blades and other components having internal passageways can be investment cast in a manner that avoids adverse reactions between the melt and the core while retaining acceptable core dimensional stability during solidification. The ceramic cores are readily removed from the cast component by chemical leaching techniques and exhibit enhanced x-ray detectability for post cast inspection procedures. The above objects and advantages of the present invention will become more readily apparent from the following detailed description taken with the following drawings.

DETAILED DESCRIPTION OF THE INVENTION

Figure 1A:
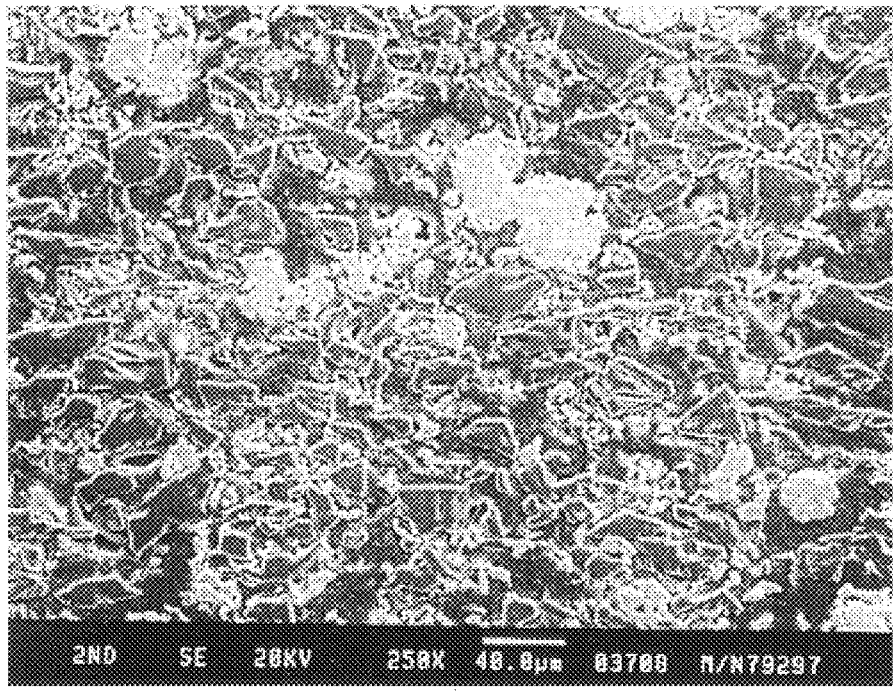
FIGS. 1A and 1B are photomicrographs at 250X and 1500X, respectively, of the microstructure of a sintered erbia-alumina ceramic core specimen pursuant to the present invention.

The present invention provides in one embodiment a ceramic core that includes, prior to core sintering, erbia ($Er_2O_3$) filler material alone or admixed with a second ceramic filler material, and a binder to provide a core that is relatively non-reactive with well known nickel and cobalt superalloys used in the manufacture of gas turbine engine blades and vanes, is dimensionally stable during directional solidification (DS) for extended times to produce single crystal and columnar grained components, is removable by known chemical leaching techniques, and exhibits enhanced x-ray detectable during post-cast inspection operations to determine if residual core material resides within cooling passageways formed in the cast component. An optional fugitive filler material may be present to impart a controlled porosity to the core when the fugitive filler material is removed during a subsequent sintering operation as descibed in the Frank et al. U.S. Pat. No. 4,837,187, the teachings of which are incorporated herein by reference.

One embodiment of the present invention provides a ceramic core that consists essentially of, prior to core sintering, at least about 15 weight %, preferably about 20 to about 35 weight %, erbia filler powder material, up to 80 weight % optional second ceramic filler powder material, up to about 10 weight % optional fugitive filler powder material, and about 10 to about 20 weight % binder. The ceramic core may comprise a greater proportion of the erbia filler powder material to provide a sintered ceramic core comprising predominantly or solely erbia filler material, although such greater proportion of erbia adds to cost of the core materials.

A second ceramic filler powder material preferably is present together with the erbia filler powder material to provide a ceramic core that consists essentially of, prior to core sintering, about 15 to about 20 weight % erbia filler powder material, about 60 to about 85 weight % second ceramic filler powder material, 0 up to about 5 weight % optional fugitive filler material, and preferably about 13 to about 16 weight % binder.

The erbia filler material can comprise calcined or fused erbia powder in the particle size −325 mesh (i.e. less than 325 mesh), although even finer powder particle sizes, such as a superfine particle size characterized by a powder surface area of 5 to 7 $m^2$/gm of powder, may offer benefits in core mechanical properties, such as core porosity and high temperature core strength and slump properties. Calcined or fused erbia filler powder can be obtained from Treibacher Auermet GmbH, A-9330 Treibach-Althofen, Austria. The above mesh size refers to U.S. Standard Screen System.

The second ceramic filler material can be selected from alumina, silica, yttria, zirconia and other suitable ceramic filler powders. Alumina powder in a size range of −325 to −900 mesh (superfine) is preferred in practicing the invention. The alumina powder can comprise both coarse and fine powders as explained in U.S. Pat. No. 4,837,187 incorporated herein by reference.

The binder can comprise a thermoplastic wax-based binder having a low melting temperature and composition of the type described in U.S. Pat. No. 4,837,187 incorporated herein by reference. The thermoplastic wax-based binder typically includes a theromplastic wax, an anti-segregation agent, and a dispersing agent in proportions set forth in U.S. Pat. No. 4,837,187. A suitable thermoplastic wax for the binder is available as Durachem wax from Dura Commodities Corp., Harrison, New York. This wax exhibits a melting point of 165 degrees F. A strengthening wax can be added to the thermoplastic wax to provide the as-molded core with higher green strength. A suitable strengthening wax is available as Strahl & Pitsch 462-C from Strahl & Pitsch, Inc. West Babylon, N.Y. A suitable anti-segregation agent is an ethylene vinyl acetate coploymer such as DuPont Elvax 310 available from E. I. DuPont de Nemours Co., Wilimington, Del. A suitable dispersing agent is oleic acid.

An optional fugitive filler material may be present to impart a controlled porosity to the core and can comprise a carbon-bearing filler material, such as reactive grade graphite powder having a particle size of −200 mesh, available from Union Carbide Corporation, Danbury, Conn.

The ceramic filler powders typically are prepared by mechanically mixing together appropriate proportions of the erbia filler powder, second ceramic filler powder, and optional fugitive filler powder using conventional powder mixing techniques. A conventional V-blender can be used to this end.

Once the filler powder mixture is prepared, the mixture is blended with the binder, such as the thermoplastic wax-based binder described in detail, in appropriate proportions to form a ceramic/binder mixture for injection molding to shape. The filler powders and binder can be blended using a conventional V-blender at an appropriate elevated temperature to melt the thermoplastic wax-based binder.

A desired core shape is formed by heating the ceramic/binder mixture above the melting temperature of the binder to render the mixture fluid for injection under pressure into a molding cavity defined between suitable mating dies which, for example, may be formed of aluminum or steel. The dies define a molding cavity having the core configuration desired. Injection pressures in the range of 500 psi to 2000 psi are used to inject the fluid ceramic/binder mixture into the molding cavity. The dies may be chilled at room temperature or slightly heated depending upon the complexity of the desired core configuration. After the ceramic/binder mixture solidifies in the molding cavity, the dies are opened, and the green, unfired core is removed.

The green, unfired core then is subjected to a prebake heat treatment with the core positioned on a ceramic setter contoured to the shape of the core. The ceramic setter, which includes a top half and a bottom half between which the core is positioned, acts as a support for the core and enables it to retain its shape during subsequent processing. After the core is positioned on the bottom half of the ceramic setter, it is covered with a graphite powder packing material which serves to phsyically extract via capillary action the binder from the core in a debinding action. The time and temperature for the prebake heat treatment are dependent on the cross-sectional thickness of the core. A suitable prebake treatment may be conducted for approximately 5 hours at 550 to 600 degrees F. for a maximum turbine blade airfoil core thickness of approximately ½ inch.

After the prebake heat treatment, the graphite packing material is brushed off the baked core and the bottom half of the ceramic setter. Then, the top half of the ceramic setter is mated with the bottom half thereof with the baked core encapsulated therebetween in preparation for sintering in ambient air to form a sintered core. Preferably, the core is sintered for approximately 1 hour using a heating rate of about 60 degrees C. to about 120 degrees C. per hour to a sintering temperature in the range of about 1650 to about 1670 degrees C.

Durng the sintering operation, any carbon-bearing fugitive filler powder material present is burned cleanly out of the core. As a result, an interconnected network of porosity is created in the sintered core. The porosity in the core aids in both the crushabiity and leachability of the core after casting and inhibits re-crystallization of the metal or alloy cast about the core. Thus, the sintered core preferably should include an amount of porosity sufficient to allow the core to be leached from the casting using standard hot aqueous caustic solutions in a reasonable time period. An interconnected core porosity of at least about 40 volume % and preferably in the range of 45 to 55 volume % is sufficient to this end.

During the sintering operation, the erbia filler powder material can react with second ceramic filler powder material present to form a core microstructure comprising 1) erbia-alumina garnet phase and 2) unreacted ceramic filler phase such as alumina as the major phases present. For example, the sintered core can have a microstructure comprising erbia-alumina garnet phase components when alumina is the second ceramic filler and an unreacted alumina phase component as the major phases present, see FIGS. 1*a* and 1*b*. Trace amounts of free, unreacted erbia and possibly $ErAlO_3$ may be present as minor phases in the sintered microstructure. The erbia-alumina garnet phase components extend throughout the sintered microstructure as a network connecting the alumina phase components to improve the high temperature stability of the microstructure.

EXAMPLES

Table I sets forth ceramic filler powder compositions for specimens ACE-1 through ACE-5 made pursuant to the present invention and also a comparison filler powder composition for specimens A devoid of an erbia filler powder. The volume percentages of the filler powder components used are shown. In specimens ACE-1 and ACE-5, erbia powder was substituted for yttria powder. Different amounts of erbia filler powder were used in specimens ACE-1 to ACE-5.

TABLE I

| | Filler Formulations | | | | | |
|---|---|---|---|---|---|---|
| Material | A v % | ACE-1 v % | ACE-2 v % | ACE-3 v % | ACE-4 v % | ACE-5 v % |
| alumina | 66.65 | 68.8 | 68.8 | 65.8 | 62.8 | 63 |
| al-1 | 10.75 | 11.1 | 11.1 | 11.1 | 11.1 | 11.1 |
| al-2 | 2.9 | 2.9 | 2.9 | 2.9 | 2.9 | 2.9 |
| graphite | 12.5 | 11.8 | 11.8 | 11.8 | 11.8 | 8 |
| yttria | 5.2 | — | 3.5 | 5.5 | 5.5 | — |
| MgO | 2 | — | — | — | — | — |
| erbia | — | 5.5 | 2 | 3 | 6 | 15 |

In Table I, the "alumina" filler component was alumina powder of −320 mesh particle size; the "al-1" component was fine alumina powder of −900 mesh particle size; the "al-2" component was reactive alumina powder (high purity Reynolds alumina powder) of a superfine particle size (e.g. powder surface area of 3.5–6.5 $m^2$/gm of powder); the "graphite" powder was −200 mesh particle size; the "yttria" powder had a surface area of 6 $m^2$/gm of powder; and the "erbia" was fused erbia powder of −325 mesh particle size.

For specimens ACE-1 to ACE-4, the filler powders were dry mixed in a 2-quart V-blender in air at room temperature for a total time of 30 minutes with 5 minutes of intensifier mixing at the end of mixing. The filler powder mixture then was blended with the thermoplastic wax-based Durachem wax described hereabove at 55 volume % filler and 45 volume % wax. The anti-segregation agent and dispersing agent were not used as they were not needed to produce acceptable specimens for testing. Blending was effected by placing a glass beaker on a hot plate set at low temperature to first melt the wax and then the filler powders were added to the melted wax and blended manually using a metal spatula in a stirring motion. After blending, batches of the wax/filler powder blend were measured out at 1.5 and 3.5 grams and pressed in a 1.125 inch diameter die at approximately 0.037 and 0.085 inch wafer thicknesses using a hand-operated hydraulic press at 10,000 psi. Wafers of the specimens A were prepared in similar manner. The wafers simulated a thin unfired core.

Wafers simulating thin cores also were pressed from composition ACE-5 in the same manner as described hereabove for compositions ACE-1 to ACE-4. The ACE-5 wafer specimens were sanded down to 0.015, 0.010, and 0.005 inch thicknesses for x-ray detection tests.

The wafer specimens A and ACE-1 to ACE-5 were debinded by prebaking in the presence of graphite packing material as described hereabove at 550 degrees C. for 5 hours and then sintered in air at 1680 degrees F. for 1 hour to form sintered wafer (simulated airfoil core) specimens. Also for specimens ACE-5, 1100 cubic centimeters of the filler powders were dry mixed in a large V-blender for a total time of 1 hour with 15 minutes of intensifier mixing at the end of mixing. The filler mixture then was blended for two hours at 250 degrees F. under vacuum with a thermoplastic wax-based binder at 55 volume % filler powder and 45 volume % binder using a small Ross mixer. The binder comprised 90 weight % Durachem paraffin based wax, 3 weight % Strahl & Pitsch strengthening wax, 3 weight % DuPont Elvax 310, anti-segregation agent, and 4 weight % oleic acid. After blending, simulated airfoil shaped core specimens were injected from the hot (250 degrees F.) blend using a Howmet-Tempcraft injection press at an injection pressure of 1700 psi to determine if fine core details could be injection molded. Fine core details acceptable for investment casting were acheived using the blend.

Figure 1B:
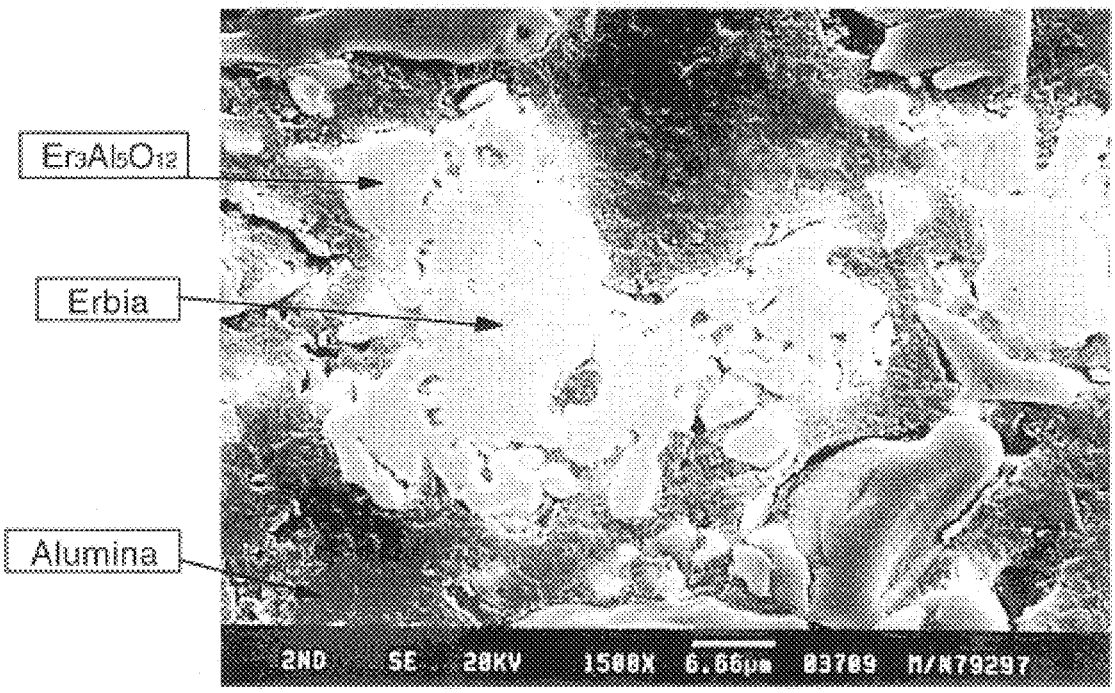

FIGS. 1A and 1B are photomicrographs at 250X and 1500X, respectively, of the microstructure of a sintered erbia-alumina ceramic wafer core specimen ACE-5 pursuant to the present invention. The pale gray areas in the microstructure are erbia and erbia-alumina garnet phases. The sintered core exhibits a microstructure comprising erbia-alumina garnet phase and unreacted alumina (corundum) phase as the major phases present. Trace amounts of free, unreacted erbia phase and possibly $ErAlO_3$ phase may be present as minor phases in the sintered microstructure. The erbia-garnet phase components extend throughout the sintered microstructure as a network connecting the alumina phase components and improve the high temperature stability of the microstructure. X-ray diffraction results confirmed that a major volume percentage of the microstructure comprised the erbia-alumina garnet phase components.

In FIG. 1B, the large central erbia powder particle shown had mostly converted to the erbia-alumina garnet phase. However, the particle center remained free erbia, probably due to insufficient mobility of the aluminum across the large particle diameter. Use of a finer erbia filler powder would appear to provide a means for reducing or eliminating the amount of free erbia present in the sintered microstructure.

Figure 2A:
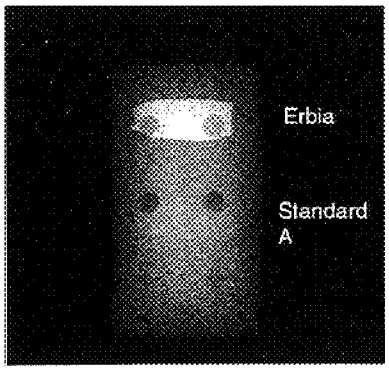
FIGS. 2A, 2B, 2C are photographs of X-ray radiogaphs showing enhanced X-ray detectability of simulated erbia-alumina core specimen placed between or on nickel base superalloy plate(s) as described in the EXAMPLES set forth herebelow. For comparison, a simulated alumina-yttria ceramic core specimen is also present as also described in the EXAMPLES set forth herebelow that is barely visible in the radiographs.
Figure 2B:
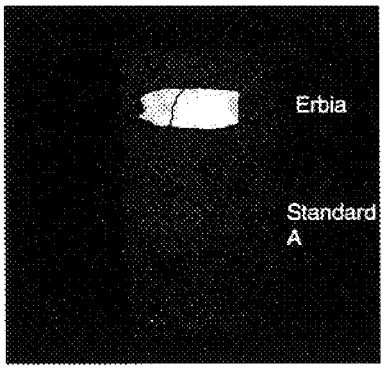
Figure 2C:
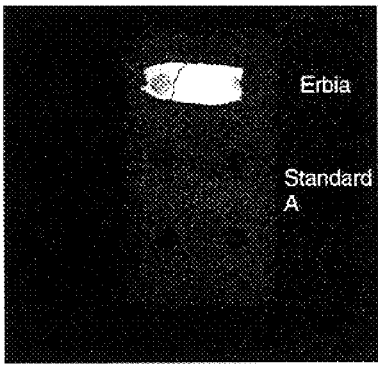

FIG. 2A illustrates the enhanced x-ray detectability of a green, unsintered wafer specimen of the invention (designated "erbia") made from a 50/50 weight % blend of the erbia powder and the filler composition A (of Table I sans graphite) to provide 30 volume % erbia in the green wafer specimen. The green wafer specimen was made using procedures described above except that a 2500 psi hydraulic press pressure was employed. The x-ray detectability of the green wafer specimen of the invention was compared to a green, unsintered wafer specimen A (Table I sans graphite and erbia) of like approximate core thickness (0.037 inch). The wafer specimens were placed between top and bottom plates of a nickel base superalloy having plate thicknesses of 0.070 inch and 0.035 inch and x-ray'ed using parameters described below. FIGS. 2B and 2C also illustrate enhanced x-ray detectabiltiy of similar green wafer specimens of the invention compared to green wafer specimen A ("Standard A") of like approximate core thickness (0.037 inch) placed on a nickel base superalloy plate of 0.070 inch thickness (FIG. 2B) and 0.140 inch thickness (FIG. 2C), respectively.

Further, the aforementioned sintered wafer specimens ACE-1 and ACE-5 with varied lower erbia levels (see Table I) than the aforementioned green wafer speicmens (30 volume % erbia) were placed inside filleted nickel base superalloy airfoil castings to simulate residual core present in the castings and x-ray'ed using conventional Phillips X-ray equipment model MGCO3 (320 kv) and film Agfa D4 to provide x-ray radiographs of the castings. X-ray detectability of the core wafer specimens in the filleted airfoil castings for compositions ACE-1 to ACE-4 was no better than that for the comparison wafer specimen A devoid of erbia. In particular, the core wafer specimens for specimens ACE-1 to ACE-4 and the comparison specimen A were barely visible in the radiographs.

In contrast, the x-ray detectability of the core wafers in the filleted airfoil castings for specimens ACE-5 having higher erbia filler content (see Table I) was considerable in that the core wafers were highly visible in the radiographs to as low as a 0.005 inch wafer thickness. The high visibility of the ACE-5 core wafer specimens on radiographs was comparable to FIG. 2 and represented a significant enhancement of x-ray detectablity of the core specimens ACE-5 as compared to that of the comparison specimens A.

As mentioned, specimens ACE-1 to ACE-4 including the 6 volume % erbia filler formulation of Table I (corresponding to 12.5 weight % erbia filler in the green, unfired core) exhibited no enhancement in x-ray detectability of the core beyond the comparison specimens A devoid of erbia. On the other hand, specimens ACE-5 including the 15 volume % erbia filler formulation of Table I (corresponding to 28.4 weight % erbia in the green, unfired core) did exhibit significant enhancement of x-ray detectability. In the practice of the invention, the erbia filler powder comprises at least about 15 weight %, preferably 20 weight % to 35 weight %, of the green, unfired core to significantly enhance x-ray detectability of any residual core in a casting passageway.

Although the invention has been described hereabove with respect to certain embodiments and aspects, those skilled in the art will appreciate that the invention is not limited to the particular embodiments and aspects described herein. Various changes and modifications may be made thereto without departing from the spirit and scope of the invention as set forth in the appended claims.

We claim:

1. An investment casting mold comprising a ceramic core in the mold, where the core has a configuration to form a passage in a metallic casting solidified about the core in said mold, said core comprising, prior to sintering, a binder, erbia filler, and a second ceramic filler, wherein said erbia filler is present in an amount of at least 15 weight % effective to improve radiographic detectability of the core in the casting.

2. The mold of claim 1 where the core includes about 20 to about 35 weight % erbia filler material, up to 85 weight % second ceramic filler material, and said binder.

3. An investment casting mold comprising a ceramic core in the mold, where the core has a configuration to form a passage in a metallic casting solidified about the core in said mold, said core consisting essentially of, prior to sintering, about 20 to about 35 weight % erbia filler material, about 60 to about 80 weight % second ceramic filler material, and about 10 to about 20 weight % binder.

4. The mold of claim 3 wherein said binder comprises a thermoplastic wax-based binder or said core.

5. The mold of claim 3 wherein said erbia filler material or said core comprises calcined or fused erbia powder.

6. The mold of claim 5 wherein said erbia filler powder or said core is present in a particle size less than 325 mesh.

7. The mold of claim 3 wherein said second ceramic filler material or said core is selected from the group consisting of alumina, silica, yttria, and zirconia powders.

8. An investment casting mold comprising a wintered ceramic core in the mold, where the core is produced by sintering the ceramic core of any one of claims 1 and 2–7 at elevated temperature.

9. An investment casting mold comprising a sintered ceramic core in the mold, where the core has a sintered microstructure comprising an erbia-alumina garnet phase and an alumina filler phase, said garnet phase being formed by sintering of a preshaped green core including erbia powder and alumina powder.

10. The mold of claim 9 wherein the sintered microstructure of said core includes some unreacted erbia.

11. The mold of claim 9 wherein the erbia-alumina garnet phase or said core comprises a majority of the microstructure.

12. A method of investment casting a component having an internal passage, comprising positioning a sintered ceramic core comprising erbia and a second ceramic material having a configuration to form said passage in a shell mold, introducing molten metal or alloy into the shell mold about the core, and solidifying the molten metal or alloy about the core to form a casting, said sintered core having an amount of erbia effective to improve radiographic detectability of said core in said casting.

13. The method of claim 12 wherein the sintered ceramic core has a microstructure comprising an erbia-alumina garnet phase and an unreacted ceramic filler phase.

14. The method of claim 12 further including removing the shell mold and the core from the casting and subjecting the casting to X-ray radiography to determine if residual core material remains in the casting.

15. A method of investment casting a nickel or cobalt based superalloy component having an internal passage, comprising positioning a sintered erbium-bearing ceramic core having a configuration to form said passage in a shell mold, introducing molten nickel or cobalt based superalloy into the shell mold about the core, and directionally solidifying the molten nickel or cobalt based superalloy about the core to form a casting having a columnar grain or single crystal microstructure, said sintered core having an amount of erbia effective to improve radiographic detectability of said core in said casting.

16. A method of investment casting a component having an internal passage, comprising positioning in a shell mold a sintered erbium-bearing ceramic core having a configuration to form said passage and having a microstructure comprising an erbia-alumina garnet phase and an unreacted alumina filler phase, introducing molten metal or alloy into the shell mold about the core, and solidifying the molten metal or alloy about the core to form a casting.

17. A method of investment casting a component having an internal passage, comprising positioning a sintered erbium-bearing ceramic core in a shell mold, introducing molten metal or alloy into the shell mold about the core, solidifying the molten metal or alloy about the core to form a casting, removing the shell mold and the core from the casting, and subjecting the casting to X-ray radiography to determine if any residual core material remains in the casting.

* * * * *